US005785924A

United States Patent [19]

Beguinot et al.

[11] Patent Number: 5,785,924

[45] Date of Patent: Jul. 28, 1998

[54] STEEL USEFUL FOR THE MANUFACTURE OF MOLDS FOR THE INJECTION MOLDING OF PLASTIC

[75] Inventors: Jean Beguinot; Frédéric Chenou, both of Le Creusot; Gilbert Primon, Saint Vallier, all of France

[73] Assignee: Creusot Loire Industrie, Puteaux, France

[21] Appl. No.: 805,851

[22] Filed: Mar. 3, 1997

[30] Foreign Application Priority Data

Mar. 1, 1996 [FR] France ..... 96 02595

[51] Int. Cl.[6] ..... C22C 38/42; C22C 38/06

[52] U.S. Cl. ..... 420/63; 420/91; 420/92; 420/61; 420/103; 148/325; 148/335; 148/336

[58] Field of Search ..... 420/91, 92, 61, 420/63, 103; 148/335, 336, 325

[56] References Cited

U.S. PATENT DOCUMENTS 3,926,621 12/1975 Asada ..... 420/91

FOREIGN PATENT DOCUMENTS

A-19 12 624 10/1969 Germany .
63-114942 5/1988 Japan .
63-125644 5/1988 Japan .
3-122252 5/1991 Japan .
5-70889 3/1993 Japan .
6-279922 10/1994 Japan .

*Primary Examiner*—Deborah Yee
*Attorney, Agent, or Firm*—Oblon, Spivak, McClelland, Maier & Neustadt, P.C.

[57] ABSTRACT

Steel useful for the manufacture of molds for the injection molding of plastics, the chemical composition of which includes, by weight: $0.03\% \leqq C \leqq 0.25\%$, $0\% \leqq Si \leqq 0.2\%$, $0\% \leqq Mn \leqq 0.9\%$, $1.5\% \leqq Ni \leqq 5\%$, $0\% \leqq Cr \leqq 18\%$, $0.05\% \leqq Mo+W/2 \leqq 1\%$, $0\% \leqq S \leqq 0.3\%$, at least one element chosen from Al and Cu in contents of between 0.5% and 3%, optionally $0.0005\% \leqq B \leqq 0.015\%$, optionally at least one element taken from V, Nb, Zr, Ta and Ti, in contents of between 0% and 0.3%, optionally at least one element taken from Pb, Se, Te and Bi, in contents of between 0% and 0.3%, the remainder being iron and impurities resulting from the processing, especially nitrogen; the chemical composition additionally satisfying the relations: $Kth=3.8\times C+9.8\times Si+3.3\times Mn+2.4\times Ni+\alpha\times Cr+1.4\times(Mo+W/2) \leqq 15$, with $\alpha=1.4$ if $Cr<8\%$ and $\alpha=0$ if $Cr \geqq 8\%$; $Tr=3.8\times C+1.07\times Mn+0.7\times Ni+0.57\times Cr+1.58\times(Mo+W/2)+kB \geqq 3.1$ with $kB=0.8$ if B is between 0.0005% and 0.015% and $kB=0$ if not; if $Cr \leqq 5\%$, $Kth/Tr \leqq 3$. Steel block of hardness greater than 350 BH and welding wire.

31 Claims, No Drawings

STEEL USEFUL FOR THE MANUFACTURE OF MOLDS FOR THE INJECTION MOLDING OF PLASTIC

BACKGROUND OF THE INVENTION

1. Field of the Invention

The present invention relates to steel which is especially useful for the manufacture of molds for the injection molding of plastic. Molds comprising the invention steel, and methods of using the invention steel, also make up part of the invention.

2. Discussion of the Art

Molds for the injection molding of plastics generally consist of assemblies of components machined from blocks of steel so as to form a cavity which has the shape of the objects to be manufactured by molding. The objects are molded in series and the successive moldings give rise to wear of the cavity surface. After the manufacture of a certain number of objects the molds are out of use and must be replaced or repaired. The repair, when feasible, consists in refilling by welding, followed by machining and polishing or chemical graining of the cavity surface. For the repair by welding to be possible it is necessary, especially, that the metal added by welding and that the regions affected by the heat of welding in the base metal have satisfactory properties. The reparability by welding is obtained, especially, by employing steel with structural hardening processed by quenching and annealing. The structural hardening is obtained by adding to the steel from 2% to 5% of nickel and at least one element taken from aluminum and copper, in contents of between 0.5% and 3%. The combined presence of nickel and copper or aluminum makes it possible to obtain by quenching and annealing a bainitic or martensitic structure whose tensile strength is of the order of 1400 MPa and the hardness approximately 400 BH. Since the hardness results from the precipitation of intermetallic compounds during the annealing, the carbon content may be limited. This limited carbon content allows the components to be repaired by welding without the hardness of the regions affected by the heat substantially exceeding 400 BH.

Besides nickel, copper and aluminum, the chemical composition of the steel includes, by weight, less than 0.25% of carbon, less than 1% of silicon, from 0.9% to 2% of manganese, from 2% to 5% of nickel, from 0% to 18% of chromium, from 0.05% to 1% of molybdenum, from 0% to 0.2% of sulfur, optionally titanium, niobium or vanadium in contents lower than 0.1%, optionally boron in contents lower than 0.005%, the remainder being iron and impurities resulting from the processing.

For some applications the molds need to withstand corrosion, and the chromium content is chosen higher than 8%. For other applications the corrosion resistance is of no particular interest, and the chromium content remains lower than 2%.

The use of molds manufactured in this way, regardless of whether they do or do not need to withstand corrosion, has the disadvantage of limiting the output efficiency of the equipment for injection molding of plastics. In fact, a molding operation comprises a number of successive stages, including a stage of solidification of the plastic by cooling, which is relatively long.

In addition, the manufacture of the molds, which is carried out especially by machining blocks of steel the thickness of which can reach 800 mm or even 1000 mm can present difficulties resulting from the presence of segregated bands. These difficulties are, furthermore, proportionally greater when the steel blocks are thick.

SUMMARY OF THE INVENTION

One object of the present invention is to overcome these disadvantages by providing a steel which is useful for the manufacture of molds for the injection molding of plastic, which has a tensile strength Rm of the order of 1400 MPa, a hardness greater than 350 BH and preferably greater than 380 BH, good weldability, satisfactory machinability even in the case of very great thicknesses, and making it possible to increase the output efficiency of the injection molding equipment by shortening the cooling periods after injection.

To this end the subject-matter of the invention is a steel, especially useful for the manufacture of molds for the injection molding of plastics, the chemical composition of which includes, by weight based on total weight of steel:

$0.03\% \leqq C \leqq 0.25\%$ $0\% \leqq Si \leqq 0.2\%$ $0\% \leqq Mn \leqq 0.9\%$ $1.5\% \leqq Ni \leqq 5\%$ $0\% \leqq Cr \leqq 18\%$ $0.05\% \leqq Mo+W/2 \leqq 1\%$ $0\% \leqq S \leqq 0.3\%$ at least one element taken from Al and Cu each in contents each of from 0.5% to 3%, optionally from 0.0005% to 0.015% of boron, optionally at least one element taken from V, Nb, Zr, Ta and Ti, each in contents of from 0% to 0.3%, optionally at least one element taken from Pb, Se, Te and Bi, each in contents of from 0% to 0.3%, preferably less than 0.003% of nitrogen, the remainder being wholly or partly iron and impurities resulting from the processing; the chemical composition preferably additionally and simultaneously satisfying the relations:

$$Kth=3.8\times C+9.8\times Si+3.3\times Mn+2.4\times Ni+\alpha\times Cr+1.4(Mo+W/2)\leqq At$$

where $\alpha=1.4$ if $Cr<8\%$ and $\alpha=0$ if $Cr\geqq 8\%$; and At=15, preferably At=13, and more preferably At=11; and:

$$Tr=3.8\times C+1.07\times Mn+0.7\times Ni+0.57\times Cr+1.58\times(Mo+W/2)+kB\geqq Bt$$

where kB=0.8 when the steel contains between 0.0005% and 0.015% of boron and kB=0 if not; Bt=3.1 and preferably Bt=4.1; and:

$$Kth/Tr\leqq Ct$$

with Ct=3, preferably Ct=2.8 and more preferably Ct=2.5.

The composition of the steel may be advantageously chosen in such a way that:

$$3.8\times C+3.3\times Mn+2.4\times Ni+\alpha\times Cr+1.4\times(Mo+W/2)\leqq 8$$

The chemical composition of the steel is preferably such that the manganese content is lower than or equal to 0.7% and, better still, lower than or equal to 0.5%; similarly, it is preferable that the silicon content is lower than or equal to 0.1%.

When the steel is intended for manufacturing molds which must withstand corrosion, the chromium content is preferably higher than or equal to 8%. When corrosion resistance is not necessary, the chromium content is preferably lower than or equal to 5% and, better still, lower than or equal to 2%, and it is preferable that the steel should contain some boron.

The invention also relates to a block of steel according to the invention of characteristic dimension d greater than or equal to 20 mm, which, at any point, has a structure that is either martensitic or bainitic or martensito-bainitic, annealed, of hardness greater than 350 BH.

The chemical composition of the steel forming the block is preferably such that:

$$3.8\times C+1.07\times Mn+0.7\times Ni+0.57\times Cr+1.58\times(Mo+W/2)+kB\geqq f(d)$$

where kB=0.8 when the steel contains between 0.0005% and 0.015% of boron and kB=0 if not, with:

$$f(d)=2.05+1.04\times log(d)$$

and preferably:

$$f(d)=-0.8+1.9\times log(d)$$

in this case the steel block must be water-quenched.

The expression "log(d)" represents the decimal logarithm of the characteristic dimension d expressed in mm.

DESCRIPTION OF THE PREFERRED EMBODIMENTS

The invention will now be described in greater detail, but without any limitation being implied, especially with the aid of the examples which follow.

The steel according to the invention is a steel preferably with structural hardening, the chemical composition of which preferably includes, by weight:

more than 0.03% of carbon, to ensure a sufficient resistance to softening on annealing, but less than 0.25%, to obtain good weldability characterized by a hardness of the welding heat affected zones not exceeding 430 BH;

from 0% to 0.2%, and preferably less than 0.1%, of silicon; this element, usually necessary for the deoxidizing of steel during the processing, should not exceed 0.2%, in order to avoid an excessive reduction of the thermal conductivity of the steel;

from 0% to 0.9% of manganese in order, on the one hand, to fix the sulfur and, on the other hand, to give the steel a sufficient quenchability; the content is limited to 0.9% and preferably to 0.7% and, better still, to 0.5%, in order, on the one hand, to contribute to obtaining the highest possible thermal conductivity and, on the other hand, and above all, to avoid the formation of segregated bands which are highly unfavorable to machinability;

from 1.5% to 5% of nickel in order, during the annealing, to form hardening precipitations with the aluminum or copper; bearing in mind the hardness level aimed at after annealing, an addition of at least 1.5% of nickel is desirable and it is unnecessary to exceed 5% because, beyond this, the effect of a supplementary addition of nickel is insignificant and this element is very costly;

from 0% to 18% of chromium and, preferably, from 8% to 18% when a corrosion resistance is necessary; when the corrosion resistance is of little use, the chromium content is preferably lower than 5% and, better still, lower than 2%;

from 0.05% to 1% of molybdenum, especially to reinforce the resistance to softening on annealing and thus to support the hardening obtained by the intermetallic precipitates of nickel, copper and aluminum; the maximum contents are set in order not to impair thermal conductivity and not to increase the cost of the steel too much; the molybdenum can be totally or partially replaced with tungsten in a proportion of 2% of tungsten per 1% of molybdenum; as a result, in the case of these two elements the analysis is defined by the value Mo+W/2;

optionally from 0.0005% to 0.015% of boron, to increase the quenchability without damaging the thermal conductivity of the steel; since chromium is an element which appreciably increases the quenchability of steel, the addition of boron is particularly desirable when the chromium content is lower than or equal to 2%;

from 0% to 0.3% of sulfur; this element improves machinability but, in too high content, it is detrimental to the quality of the active surfaces of the molds, which surfaces are generally either polished or grained;

at least one element taken from aluminum and copper in contents of between 0.5% and 3% each, to obtain a structural hardening effect by precipitation of intermetallic compounds during the annealing, which makes it possible to obtain both great hardness and good weldability;

optionally, at least one element taken from vanadium, niobium, zirconium, tantalum and titanium, in contents each of which is between 0% and 0.3% and preferably each higher than 0.01%, in particular to make the effect of the boron more reliable, especially when the steel is quenched in the forging or rolling heat;

optionally at least one element taken from lead, selenium, tellurium and bismuth, in contents each of which is between 0.1% and 0.3%, in order to improve the machinability without damaging too much the polishability or the chemical grainability;

preferably less than 0.003% of nitrogen, to avoid the formation of coarse aluminum nitrides which are unfavorable for obtaining good polishability; the remainder being iron and impurities resulting from the processing.

It is not always possible or desirable to limit the nitrogen content to less than 0.003%, in particular because it is costly to remove the nitrogen introduced by the processing. When the nitrogen content cannot be limited to less than 0.003% it is preferable to fix the nitrogen in the form of fine titanium or zirconium nitrides. To do this it is desirable that the titanium, zirconium and nitrogen contents (these elements being always present, at least as impurities in contents of between a few ppm and several hundred ppm) should be such that:

$$0.00003\leqq(N)\times(Ti+Zr/2)\leqq 0.0016$$

and that the titanium or zirconium should be introduced into the steel by gradual dissolving of an oxidized titanium or zirconium phase, for example by performing the addition of titanium or zirconium into undeoxidized steel, and by then adding a strong deoxidizing agent such as aluminum. These conditions make it possible to obtain a very fine dispersion of titanium or zirconium nitrides which is favorable to toughness, to machinability and to polishability. When the titanium or the zirconium is introduced in this preferred manner, the number of titanium or zirconium nitrides of size greater than 0.1 μm, counted over a 1-mm$^2$ area of a micrographic section of solid steel, is smaller than 4 times the sum of the total content of titanium precipitated in the form of nitrides and of half of the total content of zirconium precipitated in the form of nitrides, expressed in thousandths of %.

The chemical composition of the steel must additionally satisfy two conditions relating, on the one hand, to quenchability and, on the other hand, to thermal conductivity.

In order to obtain satisfactory mechanical strength and hardness characteristics, tensile strength of approximately 1400 MPa and hardness of about 400 BH (that is to say at least greater than 350 BH and preferably greater than 380 BH), the components constituting the molds for injection molding of plastic must be machined from blocks which are first quenched to give them a structure that is either entirely martensitic or entirely bainitic or mixed martensito-bainitic, but, whatever the circumstances, free from ferrite and perlite, and then annealed to harden them by precipitation of intermetallic compounds. The quenching may be done, for example, by cooling with water, oil or air after austenitization, preferably between 850° C. and 1050° C., or directly in the forging or rolling heat. The annealing is generally performed between 500° C. and 550° C.

The blocks are, for example, rolled sheets or forged broad plates whose thickness is greater than 20 mm and can run up to 800 mm, or even 1000 mm. In these conditions, in order that the structure should be entirely quenched, including within the blocks, the quenchability of the steel must be sufficient. For this purpose the chemical composition of the steel preferably satisfies the following relation:

$$Tr=3.8\times C+1.07\times Mn+0.7\times Ni+0.57\times Cr+1.58\times(Mo+W/2)+kB\geqq Bt$$

where kB=0.8 when the steel contains between 0.0005% and 0.015% of boron and kB=0 if not.

The constant Bt, which represents the minimum quenchability to be obtained, preferably is at least equal to 3.1 and, in the case of large thicknesses, preferably at least equal to 4.1.

More precisely, each block has a characteristic dimension d which determines the rate of cooling at the core for a determined cooling method. To obtain the desired structure, the quenchability must be adapted to the characteristic dimension d and, for this purpose, the chemical composition of the steel is preferably such that:

$$3.8\times C+1.07\times Mn+0.7\times Ni+0.57\times Cr+1.58\times(Mo+W/2)+kB\geqq f(d)$$

with:

$$f(d)=2.05+1.04\times log(d)$$

when the block is quenched by cooling with air, and:

$$f(d)=-0.8+1.9\times log(d)$$

when the steel block is quenched with water, which is preferable.

The expression "log(d)" represents the decimal logarithm of the characteristic dimension d expressed in mm. This characteristic dimension is, for example, the thickness of a sheet or the diameter of a round bar.

Furthermore, the inventors have found that it is possible to minimize the thermal resistivity of the steel by suitably choosing its chemical composition. This has the advantage of making it possible to increase the output efficiency of the plastic injection molding operations by shortening the cooling stage which follows the injection stage. For this purpose the chemical composition of the steel is preferably such that:

$$Kth=3.8\times C+9.8\times Si+3.3\times Mn+2.4\times Ni+\alpha\times Cr+1.4\times(Mo+W/2)$$

is as small as possible and, at least, that Kth is lower than 15, preferably lower than 13 and, better still lower than 11.

The composition must preferably be such that:

$$3.8\times C+3.3\times Mn+2.4\times Ni+\alpha\times Cr+1.4\times(Mo+W/2)\leqq 8$$

In these expressions, $\alpha=1.4$ if the chromium content is lower than 8% and $\alpha=0$ if the chromium content is higher than or equal to 8%. In fact, when the chromium content is higher than or equal to 8%, it is adjusted essentially as a function of considerations relating to the corrosion resistance. In the contrary case, this content may be adjusted to maximize thermal conductivity.

Kth is a dimensionless value which varies in the same direction as the thermal resistivity of the steel, that is to say inversely proportional to thermal conductivity.

In fact, in the case of the steels which do not need to withstand corrosion (Cr<8% or even Cr<5%) the essential difficulty consists in reconciling a quenchability which is sufficient to obtain the desired mechanical characteristics throughout thick components, a low manganese content in order to limit, or even avoid, the presence of segregated bands, and a thermal resistivity that is as low as possible or, what is equivalent, a thermal conductivity which is as high as possible (the problem of quenchability does not arise in the case of the steels which must withstand corrosion, because of the high chromium content). The inventors have found that, to obtain this optimum, it is desirable and possible to add an additional condition relating to the Kth/Tr ratio, by requiring Kth/Tr to be lower than or equal to 3, preferably lower than or equal to 2.8 and, better still, lower than or equal to 2.5.

A particularly advantageous solution corresponds to a steel whose chemical composition includes, by weight:

$0.1\%\leqq C\leqq 0.16\%$ $0\%\leqq Si\leqq 0.15\%$ $0.6\%\leqq Mn\leqq 0.9\%$ $2.8\%\leqq Ni\leqq 3.3\%$ $0\%\leqq Cr\leqq 0.8\%$ $0.2\%\leqq Mo+W/2\leqq 0.35\%$ $0.9\%\leqq Al\leqq 1.5\%$ $0.9\%\leqq Cu\leqq 1.5\%$ $0.0005\%\leqq B\leqq 0.015\%$ $0\%\leqq S\leqq 0.3\%$ optionally at least one element taken from V, Nb, Zr, Ta and Ti, in contents each of which is from 0% to 0.3%, optionally at least one element taken from Pb, Se, Te and Bi, in contents each of which is from 0% to 0.3%, the remainder being partly or wholly iron and impurities resulting from the processing.

With the average analysis this steel makes it possible to obtain a thermal resistivity coefficient Kth=11.75, a quenchability Tr=4.76, a Kth/Tr ratio=2.5 and a hardness greater than 350 BH, virtually uniform throughout the bulk of air-quenched blocks of thickness that can reach 800 mm.

EXAMPLES

By way of first example, mold components for injection molding of plastic were manufactured by machining sheets of thickness from 80 to 500 mm, marked A, B, C, D, E, F, F1, G, H, I, J and J1. The sheets marked A to F1 were in accordance with the invention and, by way of comparison, the sheets marked G to J1 were according to the prior art in Table 1.

All the sheets were rolled at 1100° C. before being subjected to a heat treatment to obtain hardnesses all of which were between 385 BH and 420 BH.

The thicknesses d (in mm), the heat treatments, the thermal resistivity indices Kth, the thermal conductivity values Cth (in W/m/° K.) and the quenchability indices Tr (K and Tr are dimensionless indices) are shown in Table 2.

TABLE 1

(weight percents are $\times 10^{-3}$)

| | C | Si | Mn | Ni | Cr | Mo | Al | Cu | Nb | V | B |
|---|---|---|---|---|---|---|---|---|---|---|---|
| A | 115 | 45 | 500 | 3100 | 150 | 310 | 1100 | 1050 | | | 3 |
| B | 105 | 57 | 750 | 3040 | 160 | 295 | 1140 | 1050 | 30 | | 3 |
| C | 115 | 85 | 710 | 3110 | 140 | 305 | 1110 | 1600 | | | 3 |
| D | 130 | 50 | 300 | 2750 | 130 | 285 | 1090 | 1070 | | | 3 |
| E | 120 | 130 | 850 | 3020 | 150 | 305 | 1110 | 1075 | | 55 | 3 |
| F | 100 | 30 | 200 | 2500 | 100 | 250 | 1120 | 1080 | | | 3 |
| F1 | 130 | 85 | 850 | 2800 | 1200 | 300 | 1120 | 1080 | | | 3 |
| G | 130 | 350 | 1150 | 3050 | 200 | 290 | 1100 | 1060 | | | |
| H | 125 | 65 | 1520 | 3100 | 190 | 320 | 1130 | 1020 | | | |
| I | 145 | 85 | 1090 | 3200 | 210 | 305 | 1120 | 1050 | | | 3 |
| J | 140 | 490 | 1600 | 3100 | 850 | 340 | 1050 | 1450 | | | |
| J1 | 130 | 350 | 1500 | 3000 | 1000 | 300 | 1050 | 1450 | | | |

The results reported in Table 2 show that the steels according to the invention have thermal conductivities from 10% (E compared with H) to 60% (F compared with J) higher than those of the steels according to the prior art. These higher thermal conductivities enable the output efficiency of the molds to be significantly increased by reducing the duration of the cooling stages during the molding cycles. Steels F1 and I, J and J1 can also be compared, all four of which allow blocks of 900 mm thickness to be manufactured by air cooling. Steel F1 according to the invention has a thermal conductivity that is 30% higher than that of steels J and J1 in accordance with the prior art. In addition, the manganese content of steel F1 is very substantially lower than that of these steels, which is highly favorable for reducing segregations. Steel I in accordance with the prior art, though having a low silicon content, has a thermal conductivity that is more than 10% lower than that of steel F1.

TABLE 2

| | d | Austenitization | Quench | Annealing | Kth | Tr | Cth | Kth/Tr |
|---|---|---|---|---|---|---|---|---|
| A | 80 | 950° C. | Air | 525° C.-2 h | 10.6 | 4.5 | 43 | 2.3 |
| B | 130 | Rolling heat | Air | 525° C.-2 h | 11.4 | 4.7 | 40 | 2.4 |
| C | 500 | 950° C. | Water | 525° C.-3 h | 11.7 | 4.7 | 40 | 2.5 |
| D | 200 | 950° C. | Water | 525° C.-3 h | 9.2 | 4.1 | 45 | 2.2 |
| E | 150 | 950° C. | Air | 525° C.-2 h | 12.4 | 4.8 | 39 | 2.6 |
| F | 100 | 950° C. | Water | 525° C.-2 h | 7.8 | 3.3 | 47 | 2.4 |
| F1 | 900 | ? 950° C. | Air | ? 525° C.-2 h | 12.1 | 5.32 | 39 | 2.3 |
| G | 80 | 950° C. | Air | 525° C.-2 h | 15.7 | 4.4 | 34 | 3.6 |
| H | 400 | 950° C. | Water | 525° C.-3 h | 14.3 | 4.9 | 36 | 2.9 |
| I | 130 | 950° C. | Air | 525° C.-2 h | 13.4 | 5.3 | 35 | 2.5 |
| J | 150 | 950° C. | Air | 525° C.-2 h | 19.7 | 5.4 | 29 | 3.6 |
| J1 | 900 | 950° C. | Air | 525° C.-2 h | 17.9 | S.2 | 30 | 3.4 |

By way of second example, molds for injection molding of plastics, which must withstand corrosion, were manufactured with steel M according to the invention and N in accordance with the prior art. These steels were rolled into the form of sheets of 150 mm thickness and then subjected to a heat treatment by air quenching and annealing at 550° C. for 2 hours. The chemical analyses, in thousandths of % by weight, are shown in Table 3, and the characteristics obtained, in Table 4.

TABLE 3

(weight percents are $\times 10^{-3}$)

| | C | Si | Mn | Ni | Cr | Mo | Al | Cu | Nb | V | B |
|---|---|---|---|---|---|---|---|---|---|---|---|
| M | 40 | 50 | 300 | 3500 | 16000 | 600 | 2200 | 1550 | | | |
| N | 50 | 450 | 1100 | 4100 | 16000 | 550 | 2100 | 1450 | | | |

TABLE 4

| | BH | Kth | Tr | Cth |
|---|---|---|---|---|
| M | 415 | 10.8 | 13.0 | 22 |
| N | 430 | 18.8 | 14.2 | 18 |

A 20% difference in thermal conductivity is found in favor of the steel according to the invention, which results in the same advantages as those which were indicated above.

In general, the steel according to the invention is manufactured in the form of rolled sheets or in the form of bars or of forged wide plates, but it can also be manufactured in any other form and, in particular, in wire form.

In order that the portions repaired by welding should have the same properties as the bulk of the mold, both the thermal conductivity and the properties required for the surface of the cavity, repair by welding must preferably be carried out with welding wires of a composition close to the composition of the bulk of the mold. Accordingly, the steel according to the invention is also manufactured in the form of welding wire.

In this application all given value ranges include all values, ranges and subranges between all given values.

This application is based on French application 96 02595 filed Mar. 1, 1996, incorporated herein by reference.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by: Letters Patent of the United States is:

1. Steel, whose chemical composition comprises, by weight based on total weight of said steel:

$0.03\% \leqq C \leqq 0.25\%$ $0\% \leqq Si \leqq 0.2\%$ $0\% \leqq Mn \leqq 0.9\%$ $1.5\% \leqq Ni \leqq 5\%$ $0\% \leqq Cr \leqq 18\%$ $0.05\% \leqq Mo+W/2 \leqq 1\%$ $0\% \leqq S \leqq 0.3\%$ at least one element taken from Al and Cu each in contents of from 0.5% to 3%, optionally $0.0005\% < B < 0.015\%$, optionally at least one element taken from V, Nb, Zr, Ta and Ti, each in contents of from 0% to 0.3%, optionally at least one element taken from Pb, Se, Te and Bi, each in contents of from 0% to 0.3%, iron and impurities resulting from processing, the chemical composition additionally satisfying the relations:

$$Kth=3.8\times C+9.8\times Si+3.3\times Mn+2.4\times Ni+\alpha\times Cr+1.4\times(Mo+W/2) \leqq 15$$

where $\alpha=1.4$ if $Cr<8\%$ and $\alpha=0$ if $Cr \geqq 8\%$, and:

$$Tr=3.8\times C+1.07\times Mn+0.7\times Ni+0.57\times Cr+1.58\times(Mo+W/2)+kB \geqq 3.1$$

where kB=0.8 if the boron content is between 0.0005% and 0.015% and kB=0 if not, and if $Cr \leqq 5\%$;

$$Kth/Tr \leqq 3.$$

2. The steel as claimed in claim 1, wherein:

$$Kth=3.8\times C+9.8\times Si+3.3\times Mn+2.4\times Ni+\alpha\times Cr+1.4\times(Mo+W/2) \leqq 13.$$

3. The steel as claimed in claim 2, wherein:

$$Kth=3.8\times C+9.8\times Si+3.3\times Mn+2.4\times Ni+\alpha\times Cr+1.4\times(Mo+W/2) \leqq 11.$$

4. The steel as claimed in claim 1, wherein:

$$3.8\times C+3.3\times Mn+2.4\times Ni+\alpha\times Cr+1.4\times(Mo+W/2) \leqq 8$$

where $\alpha=1.4$ if $Cr<8\%$ and $\alpha=0$ if $Cr \geqq 8\%$.

5. The steel as claimed in claim 1, wherein:

$$Tr=3.8\times C+1.07\times Mn+0.7\times Ni+0.57\times Cr+1.58\times(Mo+W/2)+kB \geqq 4.1.$$

6. The steel as claimed in claim 1, wherein:

$$Kth/Tr \leqq 2.8.$$

7. The steel as claimed in claim 6, wherein:

$$Kth/Tr \leqq 2.5.$$

8. The steel as claimed in claim 1, whose chemical composition is such that:

$$Mn \leqq 0.7\%.$$

9. The steel as claimed in claim 8, whose chemical composition is such that:

$$Mn<0.5\%.$$

10. The steel as claimed in claim 1, whose chemical composition is such that:

$$Si \leqq 0.1\%.$$

11. The steel as claimed in claim 1, wherein:

$$Cr \leqq 5\%.$$

12. The steel as claimed in claim 11, wherein:

$$Cr \leqq 2\%$$

$$0.0005\% \leqq B \leqq 0.005\%.$$

13. The steel as claimed in claim 1, wherein:

$$Cr>8\%.$$

14. The steel as claimed in claim 1, wherein the nitrogen content is lower than 0.003%.

15. A block comprising the steel of claim 1, wherein said block has a characteristic dimension d greater than or equal to 20 mm and the entire microstructure, has an annealed martensitic, bainitic or martenstic-bainitic structure of hardness greater than 350 BH.

16. The block as claimed in claim 15, wherein the chemical composition of the steel is such that:

$$3.8\times C+1.07\times Mn+0.7\times Ni+0.57\times Cr+1.58\times(Mo+W/2)+kB \geqq 2.05+(1.04\times \log(d)).$$

17. The block as claimed in claim 15, wherein the chemical composition of the steel is such that:

$$3.8\times C+1.07\times Mn+0.7\times Ni+0.57\times Cr+1.58\times(Mo+W/2)+kB \geqq -0.8+(1.9\times \log(d)).$$

18. A welding wire comprising the steel of claim 1.

19. The steel as claimed in claim 2, wherein $Cr \geqq 8\%$.

20. The steel as claimed in claim 3, wherein $Cr \geqq 8\%$.

21. The steel as claimed in claim 4, wherein $Cr \geqq 8\%$.

22. The steel as claimed in claim 5, wherein $Cr \geqq 8\%$.

23. The steel as claimed in claim 6, wherein $Cr \geqq 8\%$.

24. The steel as claimed in claim 7, wherein $Cr \geqq 8\%$.

25. The steel as claimed in claim 8, wherein $Cr \geqq 8\%$.

26. The steel as claimed in claim 9, wherein $Cr \geqq 8\%$.

27. The steel as claimed in claim 10, wherein $Cr \geqq 8\%$.

28. The steel as claimed in claim 14, wherein $Cr \geqq 8\%$.

29. A block comprising the steel of claim 13, wherein said block has a characteristic dimension $d \geqq$ to 20 mm and the entire microstructure has an annealed martensitic, banitic, or martensitic-banitic structure of hardness greater than 350 BH.

30. A welding wire comprising the steel of claim 8.

31. The steel as claimed in claim 1 having a hardness greater than 380 BH.

* * * * *